US009751128B2

(12) United States Patent
Sugiura et al.

(10) Patent No.: US 9,751,128 B2
(45) Date of Patent: Sep. 5, 2017

(54) PULLING-UP-TYPE CONTINUOUS CASTING APPARATUS AND PULLING-UP-TYPE CONTINUOUS CASTING METHOD

(71) Applicant: TOYOTA JIDOSHA KABUSHIKI KAISHA, Toyota-shi (JP)

(72) Inventors: Naoaki Sugiura, Takahama (JP); Yusuke Yokota, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/036,977

(22) PCT Filed: Oct. 1, 2014

(86) PCT No.: PCT/JP2014/077025
§ 371 (c)(1),
(2) Date: May 16, 2016

(87) PCT Pub. No.: WO2015/079810
PCT Pub. Date: Jun. 4, 2015

(65) Prior Publication Data

US 2016/0256920 A1 Sep. 8, 2016

(30) Foreign Application Priority Data

Nov. 26, 2013 (JP) ..... 2013-244006

(51) Int. Cl.
*B22D 11/18* (2006.01)
*B22D 11/01* (2006.01)
(Continued)

(52) U.S. Cl.
CPC ..... *B22D 11/188* (2013.01); *B22D 11/01* (2013.01); *B22D 11/145* (2013.01); *B22D 11/20* (2013.01)

(58) Field of Classification Search
CPC ..... B22D 11/01; B22D 11/188; B22D 11/20; B22D 11/145; B22D 11/041; B22D 11/14
See application file for complete search history.

(56) References Cited

U.S. PATENT DOCUMENTS 4,515,204 A 5/1985 Ohno
5,757,506 A 5/1998 Tabatabaei
(Continued)

FOREIGN PATENT DOCUMENTS

CN 1045718 A 10/1990
CN 101377008 A 3/2009
(Continued)

OTHER PUBLICATIONS

International Search Report Issued Mar. 26, 2015 in PCT/JP2014/077025 Filed Oct. 1, 2014.
(Continued)

*Primary Examiner* — Kevin P Kerns
*Assistant Examiner* — Steven Ha
(74) *Attorney, Agent, or Firm* — Oblon, McClelland, Maier & Neustadt, L.L.P.

(57) ABSTRACT

A pulling-up-type continuous casting apparatus includes a holding furnace that holds molten metal, a shape defining member disposed above a surface of the molten metal held in the holding furnace, and configured to define a cross-sectional shape of a cast-metal article as the molten metal passes through it, an image pickup unit that takes an image of the molten metal that has passed through the shape defining member, an image analysis unit that detects a fluctuation on the molten metal from the image and determines a solidification interface based on presence/absence of the fluctuation, and a casting control unit that changes a casting condition only when the solidification interface determined by the image analysis unit is not within a
(Continued)

predetermined reference range. The casting control unit uses a reference range which differs according to the pulling-up angle of the molten metal.

10 Claims, 12 Drawing Sheets

(51) Int. Cl.
*B22D 11/14* (2006.01)
*B22D 11/20* (2006.01)

(56) References Cited

U.S. PATENT DOCUMENTS

| | | | |
|---|---|---|---|
| 6,217,803 | B1 | 4/2001 | Uozumi |
| 2009/0064923 | A1 | 3/2009 | Takanashi |
| 2013/0171021 | A1 | 7/2013 | Yaokawa et al. |
| 2015/0071817 | A1 | 3/2015 | Sasaki et al. |
| 2015/0298205 | A1 | 10/2015 | Sugiura |

FOREIGN PATENT DOCUMENTS

| | | | |
|---|---|---|---|
| DE | 197 38 466 | C1 | 12/1998 |
| EP | 0 387 006 | A2 | 9/1990 |
| JP | 62-57418 | B2 | 12/1987 |
| JP | 63-30149 | A | 2/1988 |
| JP | 63-199050 | A | 8/1988 |
| JP | 9-248657 | A | 9/1997 |
| JP | 2012-61518 | A | 3/2012 |
| JP | 2013-193098 | A | 9/2013 |
| JP | 2014-104467 | A | 6/2014 |
| WO | 2012/035752 | A1 | 3/2012 |
| WO | 2013/136785 | A1 | 9/2013 |

OTHER PUBLICATIONS

Office Action dated Jul. 14, 2016 in co-pending U.S. Appl. No. 14/646,978.
Office Action dated Feb. 23, 2017 in co-pending U.S. Appl. No. 14/646,978.
Office Action issued Dec. 15, 2015 in Japanese Application No. 2012-256512 (submitting partial English language translation only).

PULLING-UP-TYPE CONTINUOUS CASTING APPARATUS AND PULLING-UP-TYPE CONTINUOUS CASTING METHOD

TECHNICAL FIELD

The present invention relates to a pulling-up-type continuous casting apparatus and a pulling-up-type continuous casting method.

BACKGROUND ART

Patent Literature 1 proposes a free casting method as a revolutionary pulling-up-type continuous casting method that does not requires any mold. As shown in Patent Literature 1, after a starter is submerged under the surface of a melted metal (molten metal) (i.e., molten-metal surface), the starter is pulled up, so that some of the molten metal follows the starter and is drawn up by the starter by the surface film of the molten metal and/or the surface tension. Note that it is possible to continuously cast a cast-metal article having a desired cross-sectional shape by drawing the molten metal and cooling the drawn molten metal through a shape defining member disposed in the vicinity of the molten-metal surface.

In the ordinary continuous casting method, the shape in the longitudinal direction as well as the shape in cross section is defined by the mold. In the continuous casting method, in particular, since the solidified metal (i.e., cast-metal article) needs to pass through the inside of the mold, the cast-metal article has such a shape that it extends in a straight-line shape in the longitudinal direction.

In contrast to this, the shape defining member used in the free casting method defines only the cross-sectional shape of the cast-metal article, while it does not define the shape in the longitudinal direction. As a result, cast-metal articles having various shapes in the longitudinal direction can be produced by pulling up the starter while moving the starter (or the shape defining member) in a horizontal direction. For example, Patent Literature 1 discloses a hollow cast-metal article (i.e., a pipe) having a zigzag shape or a helical shape in the longitudinal direction rather than the straight-line shape.

CITATION LIST

Patent Literature

PTL 1: Japanese Unexamined Patent Application Publication No. 2012-61518

SUMMARY OF INVENTION

Technical Problem

The present inventors have found the following problem.

In the free casting method disclosed in Patent Literature 1, since the molten metal pulled up through the shape defining member is cooled by a cooling gas, the solidification interface is located above the shape defining member. The position of this solidification interface has a direct influence on the dimensional accuracy and a surface quality of the cast-metal article. Therefore, it is important to detect the solidification interface and control the solidification interface within a predetermined reference range. It should be noted that when the molten metal is pulled up in the vertical direction, the solidification interface is roughly horizontal.

Further, as described above, in the free casting method disclosed in Patent Literature 1, the molten metal can be pulled up in an oblique direction as well as in the vertical direction.

The present inventors have found that when the molten metal is pulled up in an oblique direction, the solidification interface is roughly perpendicular to the pulling-up direction, not horizontal. That is, when the molten metal is pulled up in an oblique direction, the position of the solidification interface could change depending on the pulling-up direction and/or the observing point. Therefore, there has been a problem that when molten metal is pulled up in an oblique direction, the solidification interface cannot be controlled by using the reference range that is defined for the case where the molten metal is pulled up in the vertical direction.

The present invention has been made in view of the above-described problem, and an object thereof is to provide a pulling-up-type continuous casting apparatus and a pulling-up-type continuous casting method capable of controlling the solidification interface within an appropriate reference range even when the molten metal is pulled up in an oblique direction and thereby producing a cast-metal article having excellent dimensional accuracy and an excellent surface quality.

Solution to Problem

A pulling-up-type continuous casting apparatus according to an aspect of the present invention includes:

a holding furnace that holds molten metal;

a shape defining member disposed above a molten-metal surface of the molten metal held in the holding furnace, the shape defining member being configured to define a cross-sectional shape of a cast-metal article to be cast as the molten metal passes through the shape defining member;

an image pickup unit that takes an image of the molten metal that has passed through the shape defining member;

an image analysis unit that detects a fluctuation on the molten metal from the image and determines a solidification interface based on presence/absence of the fluctuation; and a casting control unit that changes a casting condition only when the solidification interface determined by the image analysis unit is not within a predetermined reference range, in which the casting control unit uses a reference range which differs according to a pulling-up angle of the molten metal and determines whether or not the solidification interface is within that reference range.

In the pulling-up-type continuous casting apparatus according to this aspect of the present invention, the casting control unit uses a reference range which differs according to the pulling-up angle of the molten metal and determines whether or not the solidification interface is within that reference range. As a result, the solidification interface can be controlled within an appropriate reference range even when the molten metal is pulled up in an oblique direction.

A pulling-up-type continuous casting method according to an aspect of the present invention includes:

pulling up a molten metal held in a holding furnace while making the molten metal pass through a shape defining member, the shape defining member being configured to define a cross-sectional shape of a cast-metal article to be cast;

taking an image of the molten metal that has passed through the shape defining member;

detecting a fluctuation on the molten metal from the image and determining a solidification interface based on presence/absence of the fluctuation; and changing a casting condition only when the determined solidification interface is not within a predetermined reference range, in which in the changing the casting condition, a reference range which differs according to a pulling-up angle of the molten metal is used and it is determined whether or not the solidification interface is within that reference range.

In the pulling-up-type continuous casting method according to this aspect of the present invention, a reference range which differs according to the pulling-up angle of the molten metal is used and it is determined whether or not the solidification interface is within that reference range. As a result, the solidification interface can be controlled within an appropriate reference range even when the molten metal is pulled up in an oblique direction.

Advantageous Effects of Invention

According to the present invention, it is possible to provide a pulling-up-type continuous casting apparatus and a pulling-up-type continuous casting method capable of controlling the solidification interface within an appropriate reference range even when the molten metal is pulled up in an oblique direction and thereby producing a cast-metal article having excellent dimensional accuracy and an excellent surface quality.

DESCRIPTION OF EMBODIMENTS

Specific exemplary embodiments to which the present invention is applied are explained hereinafter in detail with reference to the drawings. However, the present invention is not limited to exemplary embodiments shown below. Further, the following descriptions and the drawings are simplified as appropriate for clarifying the explanation.

First Exemplary Embodiment

Figure 1:
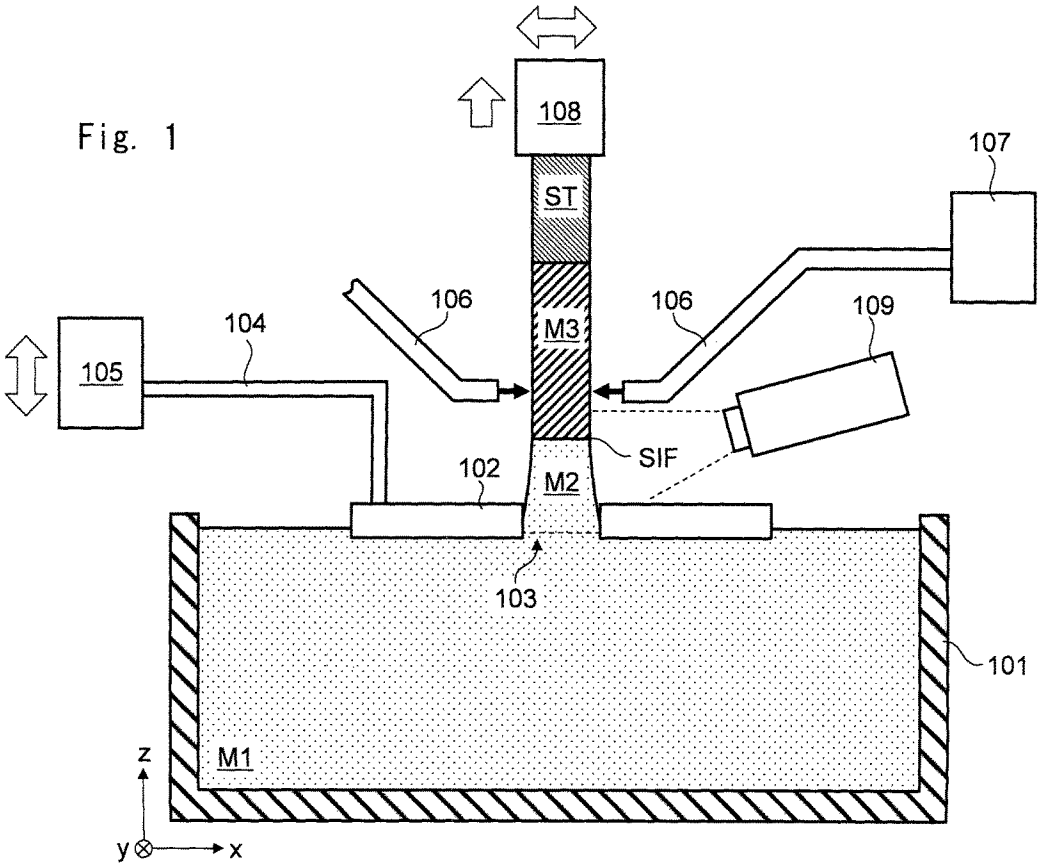
FIG. 1 is a schematic cross section of a free casting apparatus according to a first exemplary embodiment.

Firstly, a free casting apparatus (pulling-up-type continuous casting apparatus) according to a first exemplary embodiment is explained with reference to FIG. 1. FIG. 1 is a schematic cross section of a free casting apparatus according to the first exemplary embodiment. As shown in FIG. 1, the free casting apparatus according to the first exemplary embodiment includes a molten-metal holding furnace 101, a shape defining member 102, a support rod 104, an actuator 105, a cooling gas nozzle 106, a cooling gas supply unit 107, a pulling-up machine 108, and an image pickup unit (camera) 109.

Note that needless to say, the right-hand xyz-coordinate system shown in FIG. 1 is illustrated for the sake of convenience, in particular, for explaining the positional relation among components. In FIG. 1, the xy-plane forms a horizontal plane and the z-axis direction is the vertical direction. More specifically, the positive direction on the z-axis is the vertically upward direction.

The molten-metal holding furnace 101 contains molten metal M1 such as aluminum or its alloy, and maintains the molten metal M1 at a predetermined temperature at which the molten metal M1 has fluidity. In the example shown in FIG. 1, since the molten-metal holding furnace 101 is not replenished with molten metal during the casting process, the surface of molten metal M1 (i.e., molten-metal surface) is lowered as the casting process advances. Alternatively, the molten-metal holding furnace 101 may be replenished with molten metal as required during the casting process so that the molten-metal surface is kept at a fixed level. Note that the position of the solidification interface SIF can be raised by increasing the setting temperature of the molten-metal holding furnace 101 and the solidification interface SIF can be lowered by lowering the setting temperature of the molten-metal holding furnace 101. Needless to say, the molten metal M1 may be a metal other than aluminum and an alloy thereof.

The shape defining member 102 is made of ceramic or stainless, for example, and disposed above the molten metal M1. The shape defining member 102 defines the cross-sectional shape of cast metal M3 to be cast. The cast metal M3 shown in FIG. 1 is a plate or a solid cast-metal article having a rectangular shape in a horizontal cross section (hereinafter referred to as "lateral cross section"). Note that needless to say, there are no particular restrictions on the cross-sectional shape of the cast metal M3. The cast metal M3 may be a hollow cast-metal article such as a circular pipe and a rectangular pipe.

In the example shown in FIG. 1, the shape defining member 102 is disposed so that its bottom-side main surface (bottom surface) is in contact with the molten-metal surface. Therefore, it is possible to prevent oxide films formed on the surface of the molten metal M1 and foreign substances floating on the surface of the molten metal M1 from entering the cast metal M3.

Alternatively, the shape defining member 102 may be disposed so that its bottom surface is a predetermined distance away from the molten-metal surface. When the shape defining member 102 is disposed a certain distance away from the molten-metal surface, the thermal deformation and the erosion of the shape defining member 102 is prevented, thus improving the durability of the shape defining member 102.

Figure 2:
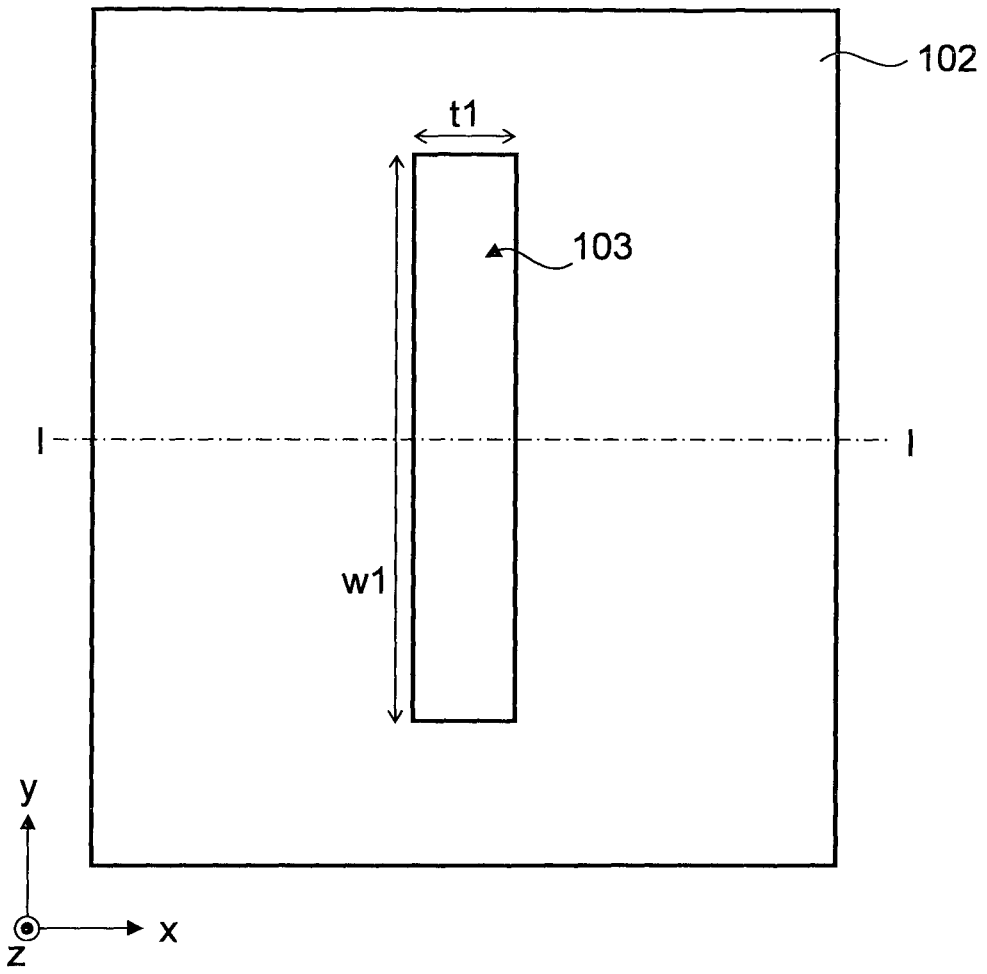
FIG. 2 is a plane view of a shape defining member 102 according to the first exemplary embodiment.

FIG. 2 is a plane view of the shape defining member 102 according to the first exemplary embodiment. Note that the cross section of the shape defining member 102 shown in FIG. 1 corresponds to a cross section taken along the line I-I in FIG. 2. As shown in FIG. 2, the shape defining member 102 has, for example, a rectangular shape as viewed from the top, and has a rectangular opening (molten-metal passage section 103) having a thickness t1 and a width w1 at the center thereof. The molten metal passes through the rectangular opening (molten-metal passage section 103). Further, the xyz-coordinate system shown in FIG. 2 corresponds to that shown in FIG. 1.

As shown in FIG. 1, the molten metal M1 follows the cast metal M3 and is pulled up by the cast metal M3 by its surface film and/or the surface tension. Further, the molten metal M1 passes through the molten-metal passage section 103 of the shape defining member 102. That is, as the molten metal M1 passes through the molten-metal passage section 103 of the shape defining member 102, an external force(s) is applied from the shape defining member 102 to the molten metal M1 and the cross-sectional shape of the cast metal M3 is thereby defined. Note that the molten metal that follows the cast metal M3 and is pulled up from the molten-metal surface by the surface film of the molten metal and/or the surface tension is called "held molten metal M2". Further, the boundary between the cast metal M3 and the held molten metal M2 is the solidification interface SIF.

The support rod 104 supports the shape defining member 102.

The support rod 104 is connected to the actuator 105. By the actuator 105, the shape defining member 102 can be moved in the up/down direction (vertical direction, i.e., z-axis direction) through the support rod 104. With this configuration, for example, it is possible to move the shape defining member 102 downward as the molten-metal surface is lowered due to the advance of the casting process.

The cooling gas nozzle (cooling section) 106 is cooling means for spraying a cooling gas (for example, air, nitrogen, or argon) supplied from the cooling gas supply unit 107 on the cast metal M3 and thereby cooling the cast metal M3. The position of the solidification interface SIF can be lowered by increasing the flow rate of the cooling gas and the position of the solidification interface SIF can be raised by reducing the flow rate of the cooling gas. Note that the cooling gas nozzle 106 can also be moved in the up/down direction (vertical direction, i.e., z-axis direction) and the horizontal direction (x-axis direction and/or y-axis direction). Therefore, for example, it is possible to move the cooling gas nozzle 106 downward in conformity with the movement of the shape defining member 102 as the molten-metal surface is lowered due to the advance of the casting process. Alternatively, the cooling gas nozzle 106 can be moved in a horizontal direction in conformity with the horizontal movement of the pulling-up machine 108.

By cooling the cast metal M3 by the cooling gas while pulling up the cast metal M3 by using the pulling-up machine 108 connected to the starter ST, the held molten metal M2 located in the vicinity of the solidification interface SIF is successively solidified from its upper side (the positive side in the z-axis direction) toward its lower side (the negative side in the z-axis direction) and the cast metal M3 is formed. The position of the solidification interface SIF can be raised by increasing the pulling-up speed of the pulling-up machine 108 and the position of the solidification interface SIF can be lowered by reducing the pulling-up speed. Further, the held molten metal M2 can be drawn up in an oblique direction by pulling up the starter ST or the molten-metal while moving the pulling-up machine 108 in a horizontal direction (x-axis direction and/or y-axis direction). Therefore, it is possible to arbitrarily change the shape in the longitudinal direction of the cast metal M3. Note that the shape in the longitudinal direction of the cast metal M3 may be arbitrarily changed by moving the shape defining member 102 in a horizontal direction instead of moving the pulling-up machine 108 in a horizontal direction.

The image pickup unit 109 continuously monitors an area(s) near the solidification interface SIF, which is the boundary between the cast metal M3 and the held molten metal M2. As described in detail later, it is possible to determine the solidification interface SIF from an image(s) taken by the image pickup unit 109.

Figure 3:
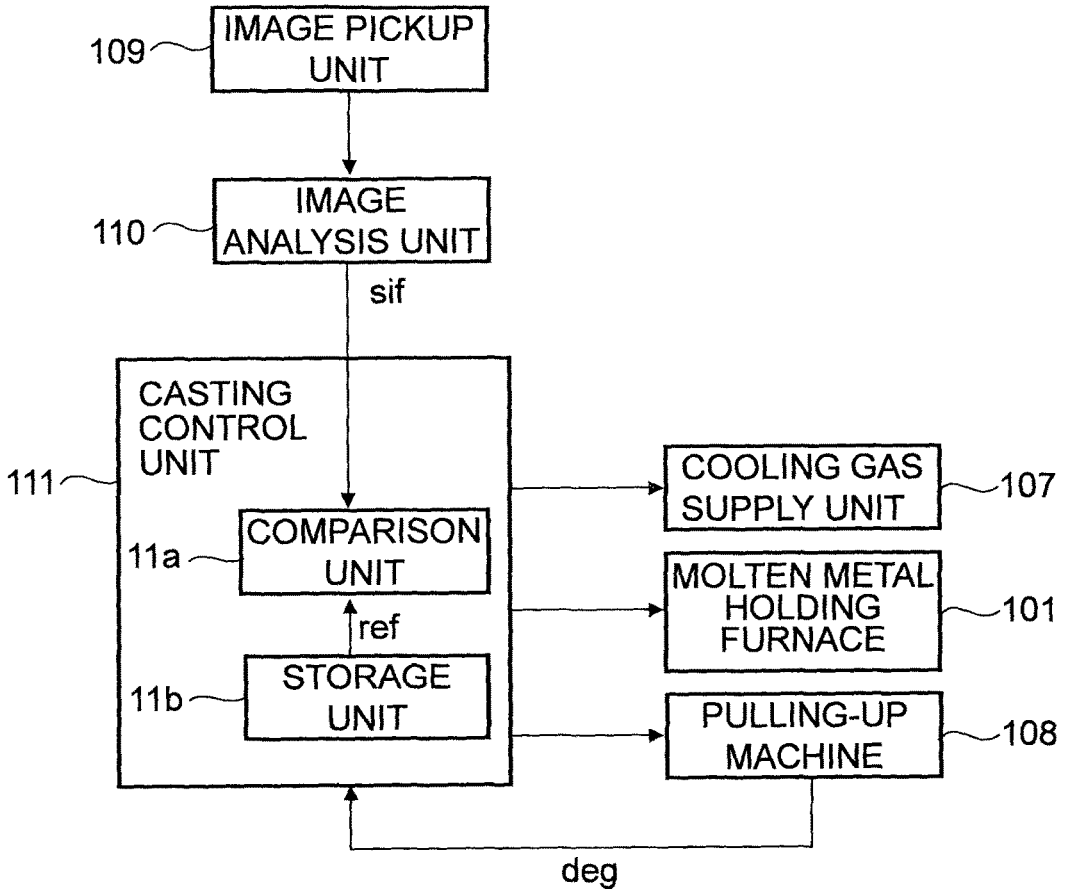
FIG. 3 is a block diagram of a solidification interface control system provided in a free casting apparatus according to the first exemplary embodiment.

Next, a solidification interface control system provided in a free casting apparatus according to the first exemplary embodiment is explained with reference to FIG. 3. FIG. 3 is a block diagram of the solidification interface control system provided in the free casting apparatus according to the first exemplary embodiment. This solidification interface control system is provided to keep the position (height) of the solidification interface SIF within a predetermined reference range.

As shown in FIG. 3, this solidification interface control system includes an image pickup unit 109, an image analysis unit 110, a casting control unit 111, a pulling-up machine 108, a molten-metal holding furnace 101, and a cooling gas supply unit 107. Note that the image pickup unit 109, the pulling-up machine 108, the molten-metal holding furnace 101, and the cooling gas supply unit 107 have already been explained with reference to FIG. 1, and therefore their detailed explanations are omitted here.

The image analysis unit 110 detects fluctuations on the surface of the held molten metal M2 from an image(s) taken by the image pickup unit 109. Specifically, the image analysis unit 110 can detect fluctuations on the surface of the held molten metal M2 by comparing a plurality of successively-taken images with one another. In contrast to this, no fluctuation occurs on the surface of the cast metal M3. Therefore, it is possible to determine the solidification interface based on the presence/absence of fluctuations.

Figure 4:
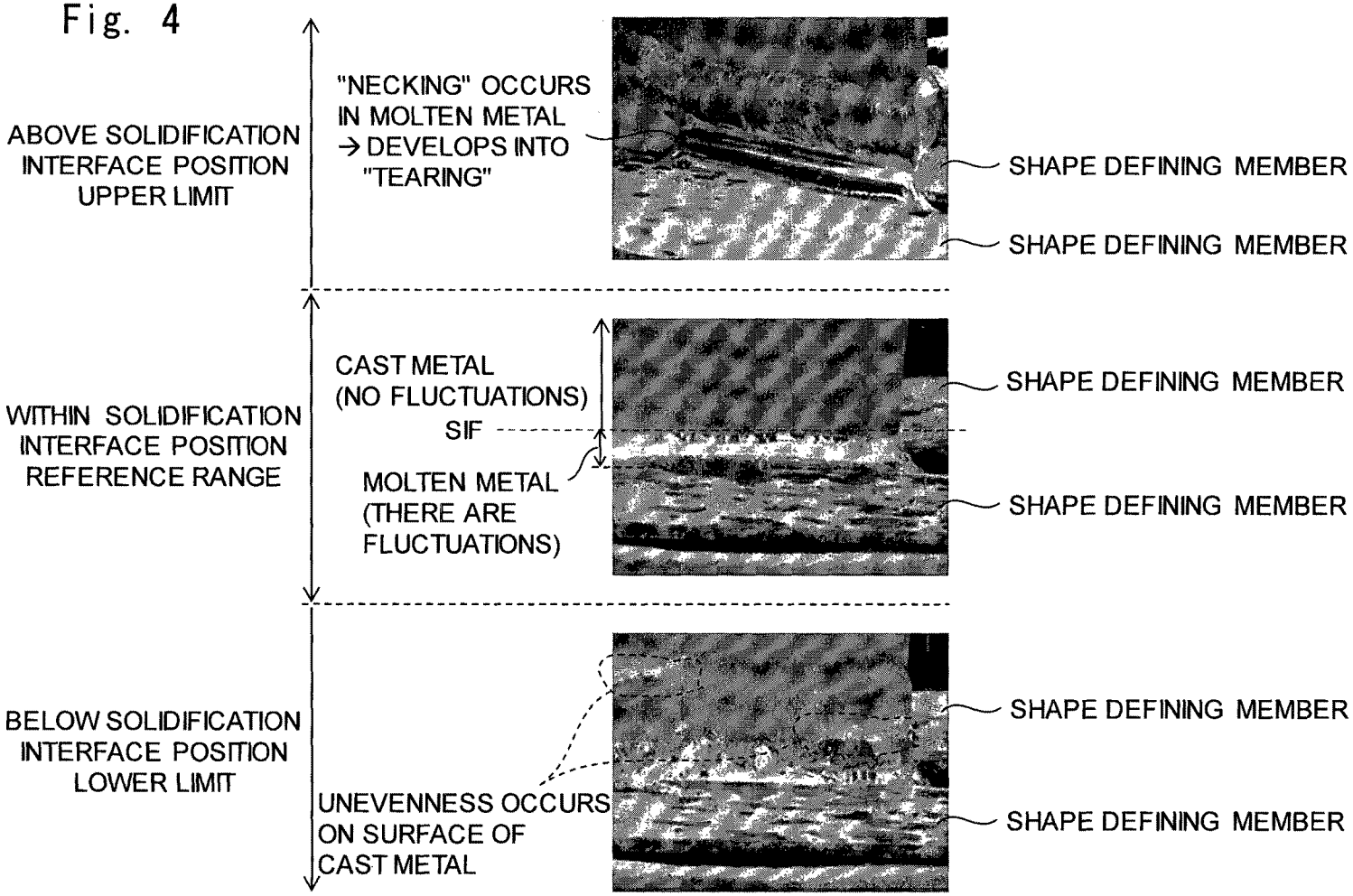
FIG. 4 shows three example images near a solidification interface.

More detailed explanation is given hereinafter with reference to FIG. 4. FIG. 4 shows three example images near the solidification interface. From the top to bottom, FIG. 4 shows an image example of a case where the position of the solidification interface rises above the upper limit, an image example of a case where the position of the solidification interface is within the reference range, and an image example of a case where the position of the solidification interface falls below the lower limit. As shown in the middle image example in FIG. 4, for example, the image analysis unit 110 determines the boundary between an area in which fluctuations are detected (i.e., the molten metal) and an area in which no fluctuation is detected (i.e., cast metal) as the solidification interface in an image(s) taken by the image pickup unit 109.

The casting control unit 111 includes a comparison unit 11*a* and a storage unit 11*b*. The comparison unit 11*a* compares a solidification interface determined by the image analysis unit 110 with a reference range. The storage unit 11*b* stores reference ranges (upper and lower limits) for solidification interface positions. It should be noted that the reference range is changed according to the pulling-up angle θ ($0°<\theta<0<180°$) with respect to the molten-metal surface of the held molten metal M2. Therefore, the storage unit 11*b* stores a table in which reference ranges (upper and lower limits) corresponding to various pulling-angles θ are recorded. The comparison unit 11*a* reads a reference range ref according to pulling-up angle information deg (which corresponds to the pulling-up angle θ) obtained from the pulling-up machine 108 from the storage unit 11*b*, i.e., reads a reference range ref corresponding to the pulling-up angle θ from the storage unit 11*b*. Then, the comparison unit 11*a* compares a solidification interface sif determined by the image analysis unit 110 with that reference range ref.

When the solidification interface determined by the image analysis unit 110 is higher than the upper limit, the casting control unit 111 reduces the pulling-up speed of the pulling-up machine 108, lowers the setting temperature of the molten-metal holding furnace 101, or increases the flow rate of the cooling gas supplied from the cooling gas supply unit 107. On the other hand, when the solidification interface determined by the image analysis unit 110 is lower than the lower limit, the casting control unit 111 increases the pulling-up speed of the pulling-up machine 108, raises the setting temperature of the molten-metal holding furnace 101, or reduces the flow rate of the cooling gas supplied from the cooling gas supply unit 107. In the control of these three conditions, two or more conditions may be changed at the same time. However, it is preferable that only one condition is changed because it makes the control easier. Further, a priority order may be determined for these three conditions in advance, and the conditions may be changed in the descending order of the priority.

The upper and lower limits for the solidification interface position are explained with reference to FIG. 4. As shown in the top image example in FIG. 4, when the solidification interface position rises above the upper limit, "necking" occurs in the held molten metal M2 and it develops into "tearing". The upper limit for the solidification interface position can be determined in advance by examining whether "necking" occurs in the held molten metal M2 or not while changing the height of the solidification interface.

On the other hand, when the solidification interface position is below the lower limit, "unevenness" occurs on the surface of the cast metal M3 as shown in the bottom image example in FIG. 4, thus causing a defective shape of the cast metal M3. The lower limit for the solidification interface position can be determined in advance by examining whether "unevenness" occurs on the surface of the cast metal M3 or not while changing the height of the solidification interface. Note that it is considered that this unevenness is caused by solidified pieces that are formed within the shape defining member 102 due to the excessively low solidification interface position.

Although FIG. 4 shows a case where the held molten metal M2 is pulled up in the vertical direction, the upper and lower limits can be determined in a manner similar to the above one in a case where the held molten metal M2 is pulled up in an oblique direction. That is, the upper and lower limits can be determined in advance for each of various pulling-up angles θ by examining whether "necking" and "unevenness" occur in these various pulling-up angles θ.

Alternatively, the upper and lower limits (reference range) may be obtained by an actual examination(s) only in the case where the held molten metal M2 is pulled up in the vertical direction. Then, the upper and lower limits in the cases where the held molten metal M2 is pulled up in oblique directions may be calculated from those upper and lower limits (reference range). In this case, as shown in FIG. 3, the storage unit 11*b* stores only the reference range in the case where the held molten metal M2 is pulled up in the vertical direction as the reference range ref. Then, the comparison unit 11*a* corrects the reference range ref according to the pulling-up angle information deg obtained from the pulling-up machine 108, and then compares the solidification interface sif determined by the image analysis unit 110 with the corrected reference range.

Figure 5:
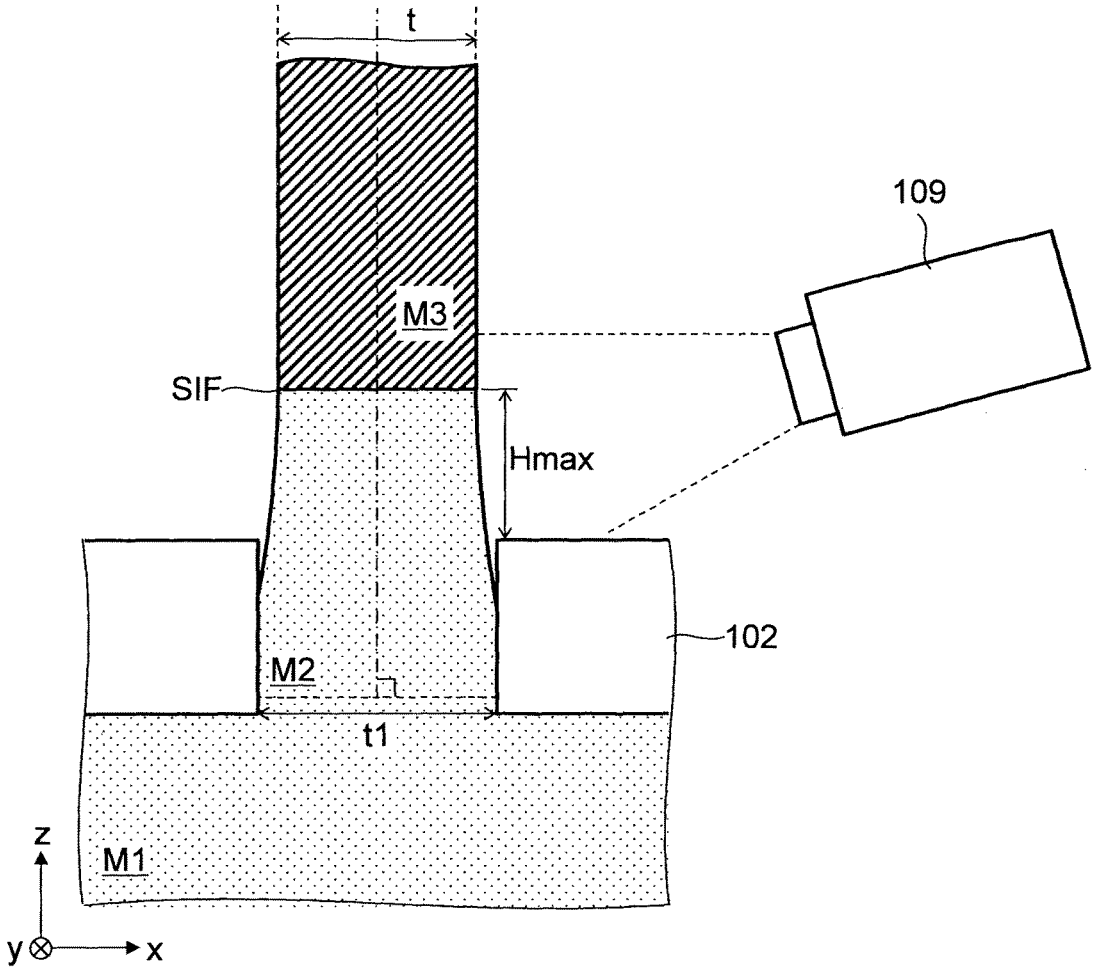
FIG. 5 is an enlarged cross section schematically showing a case where molten metal is pulled up in the vertical direction.
Figure 6:
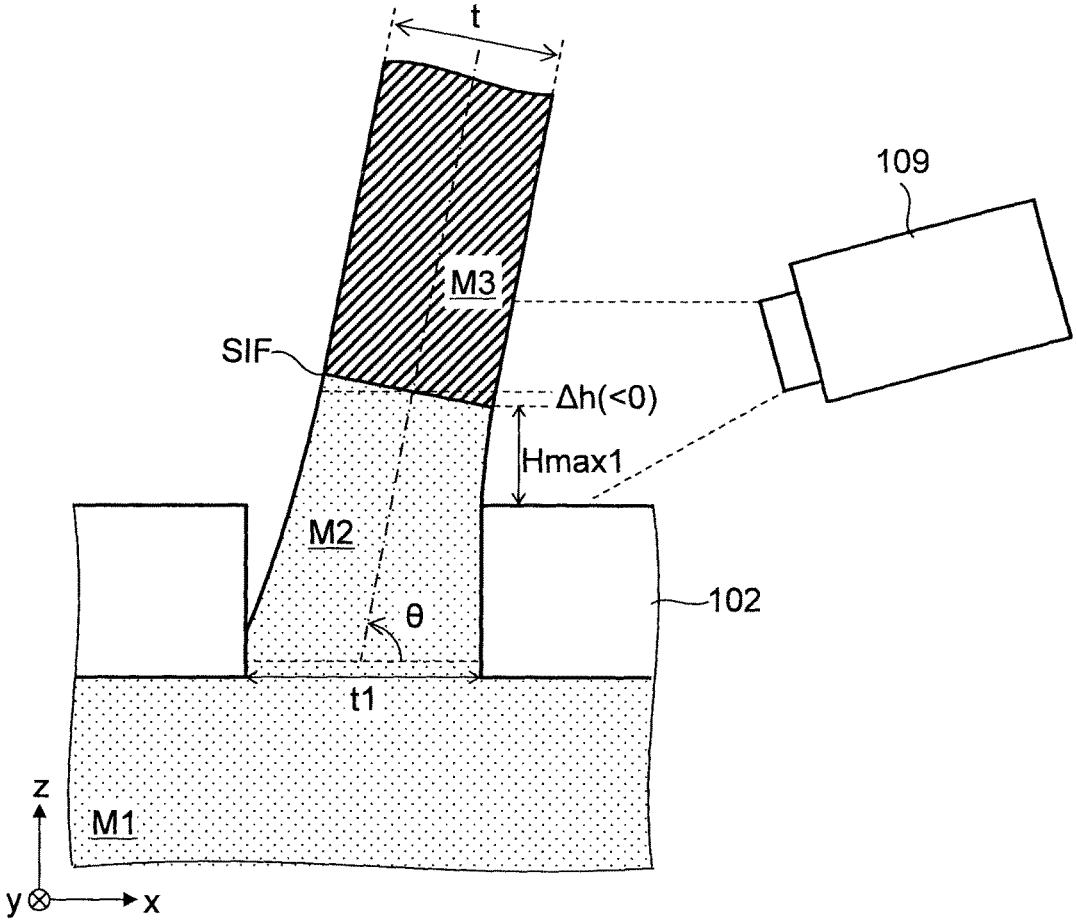
FIG. 6 is an enlarged cross section schematically showing a case where molten metal is pulled up in an oblique direction (on the observing side)
Figure 7:
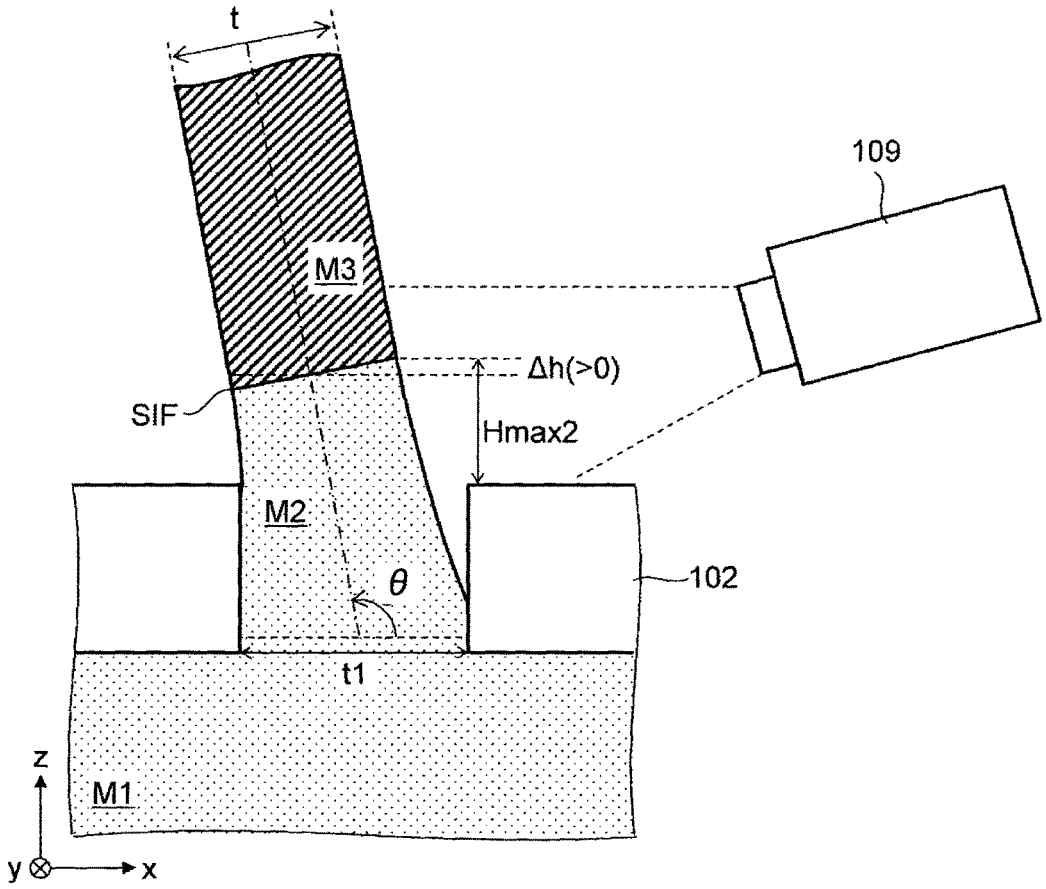
FIG. 7 is an enlarged cross section schematically showing a case where molten metal is pulled up in an oblique direction (on the side opposite to the observing side)

An example of a method for calculating the upper and lower limits in a case where the molten metal is pulled up in an oblique direction is explained with reference to FIGS. 5 to 7. FIG. 5 is an enlarged cross section schematically showing a case where the molten metal is pulled up in the vertical direction. FIG. 6 is an enlarged cross section schematically showing a case where the molten metal is pulled up in an oblique direction (on the observing side). FIG. 7 is an enlarged cross section schematically showing a case where the molten metal is pulled up in an oblique direction (on the side opposite to the observing side). Note that the xyz-coordinate systems shown in FIGS. 5 to 7 also correspond to that shown in FIG. 1.

As shown in FIG. 5, when the held molten metal M2 is pulled up in the vertical direction, the solidification interface SIF becomes roughly horizontal. Therefore, the height of the solidification interface SIF is unchanged irrespective of the observing point. Here, the position of the solidification interface SIF in FIG. 5 is defined as the upper limit Hmax of the reference range.

As shown in FIGS. 6 and 7, the angle between the molten-metal surface and the pulling-up direction as observed from the observing side is represented as the pulling-up angle θ. Further, the difference between the height at the center of the solidification interface SIF and the observed height of the solidification interface SIF is represented by Δh. As shown in FIGS. 6 and 7, this difference Δh can be geometrically calculated. That is, by using the thickness t of the cast metal M3, the difference Δh can be expressed as "$\Delta h = t/2 \times \sin(\theta - 90)$".

As shown in FIG. 6, when the pulling-up direction is inclined on the observing side, the relation $\theta < 90°$ holds and thus the relation $\Delta h < 0$ holds. Therefore, assuming that the position of the solidification interface SIF observed in FIG. 6 is defined as an upper limit Hmax1, this upper limit Hmax1 is lower than the upper limit Hmax in the case where the molten metal is pulled up in the vertical direction.

On the other hand, when the pulling-up direction is inclined on the side opposite to the observing side, the relation $\theta > 90°$ holds and thus the relation $\Delta h > 0$ holds. Therefore, assuming that the position of the solidification interface SIF observed in FIG. 7 is defined as an upper limit Hmax2, this upper limit Hmax2 is higher than the upper limit Hmax in the case where the molten metal is pulled up in the vertical direction.

Note that an upper limit Hmax(θ) when the pulling-up angle is θ can be calculated in a simplified fashion by using, for example the following expression with the upper limit Hmax in the case where the molten metal is pulled up in the vertical direction and the difference Δh.

$$H\max(\theta) = H\max + \Delta h = H\max + t/2 \times \sin(\theta - 90)$$

To be more precise, the upper limit Hmax(θ) can be calculated by using the following expression in which the difference Δh is multiplied by a coefficient C. The coefficient C can be experimentally obtained.

$$H\max(\theta) = H\max + C \times \Delta h = H\max + C \times t/2 \times \sin(\theta - 90)$$

Note that the lower limit can be obtained in a similar fashion.

Figure 8:
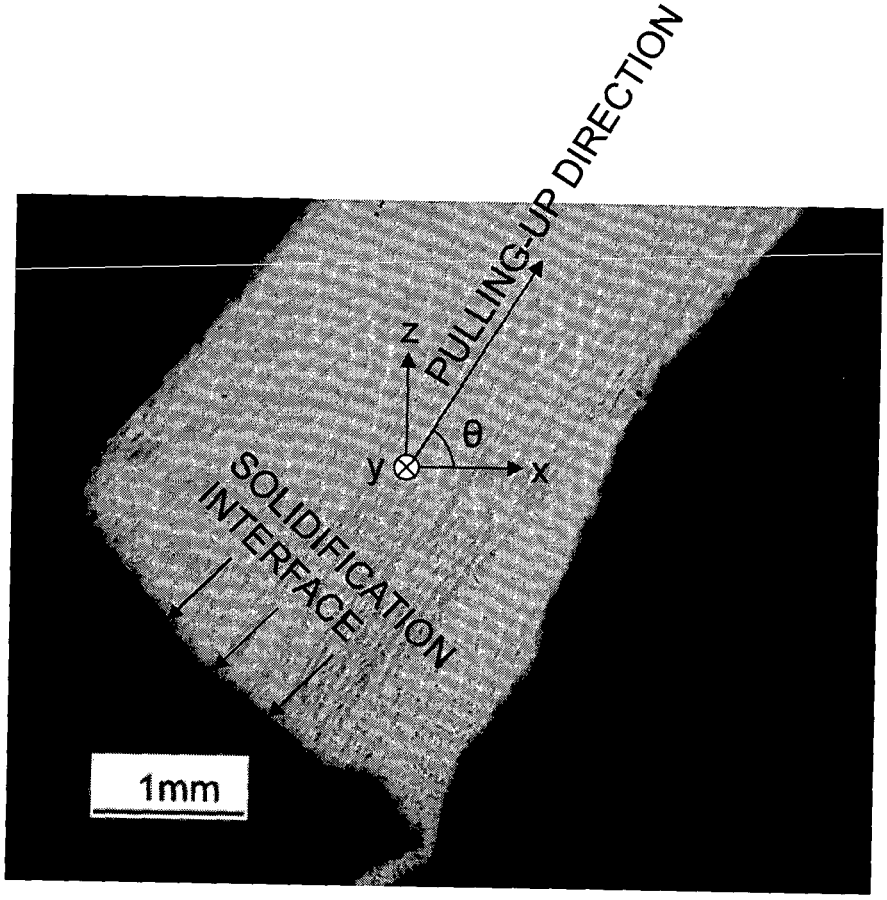
FIG. 8 is a micro-texture photograph showing a solidification interface when molten metal is pulled up in an oblique direction.

FIG. 8 is a micro-texture photograph showing a solidification interface when the molten metal is pulled up in an oblique direction. As shown in FIG. 8, when the molten metal is pulled up in a pulling-up angle θ, the solidification interface is roughly perpendicular to the pulling-up direction, not horizontal to the same.

The free casting apparatus according to the first exemplary embodiment includes an image pickup unit that takes an image(s) of an area near a solidification interface, an image analysis unit that detects fluctuations on the surface of the molten metal from the image(s) and determines the solidification interface, and a casting control unit that changes a casting condition when the solidification interface is not within a predetermined reference range. Note that the casting control unit determines whether or not the position of the solidification interface is within the reference range by using a reference range which differs according to the pulling-up angle θ. Therefore, even when the molten metal is pulled up in an oblique direction, the free casting apparatus can perform feedback control in order to keep the solidification interface within the predetermined reference range, and thereby improve the dimensional accuracy and the surface quality of the cast-metal article.

Next, a free casting method according to the first exemplary embodiment is explained with reference to FIG. 1.

Firstly, the starter ST is lowered by the pulling-up machine 108 and made to pass through the molten-metal passage section 103 of the shape defining member 102, and the tip of the starter ST is submerged into the molten metal M1.

Next, the starter ST starts to be pulled up at a predetermined speed. Note that even when the starter ST is pulled away from the molten-metal surface, the molten metal M1 follows the starter ST and is pulled up from the molten-metal surface by the surface film and/or the surface tension. That is, the held molten metal M2 is formed. As shown in FIG. 1, the held molten metal M2 is formed in the molten-metal passage section 103 of the shape defining member 102. That is, the held molten metal M2 is shaped into a given shape by the shape defining member 102.

Next, since the starter ST or the cast metal M3 is cooled by a cooling gas, the held molten metal M2 is indirectly cooled and successively solidifies from its upper side toward its lower side. As a result, the cast metal M3 grows. In this manner, it is possible to continuously cast the cast metal M3.

Figure 9:
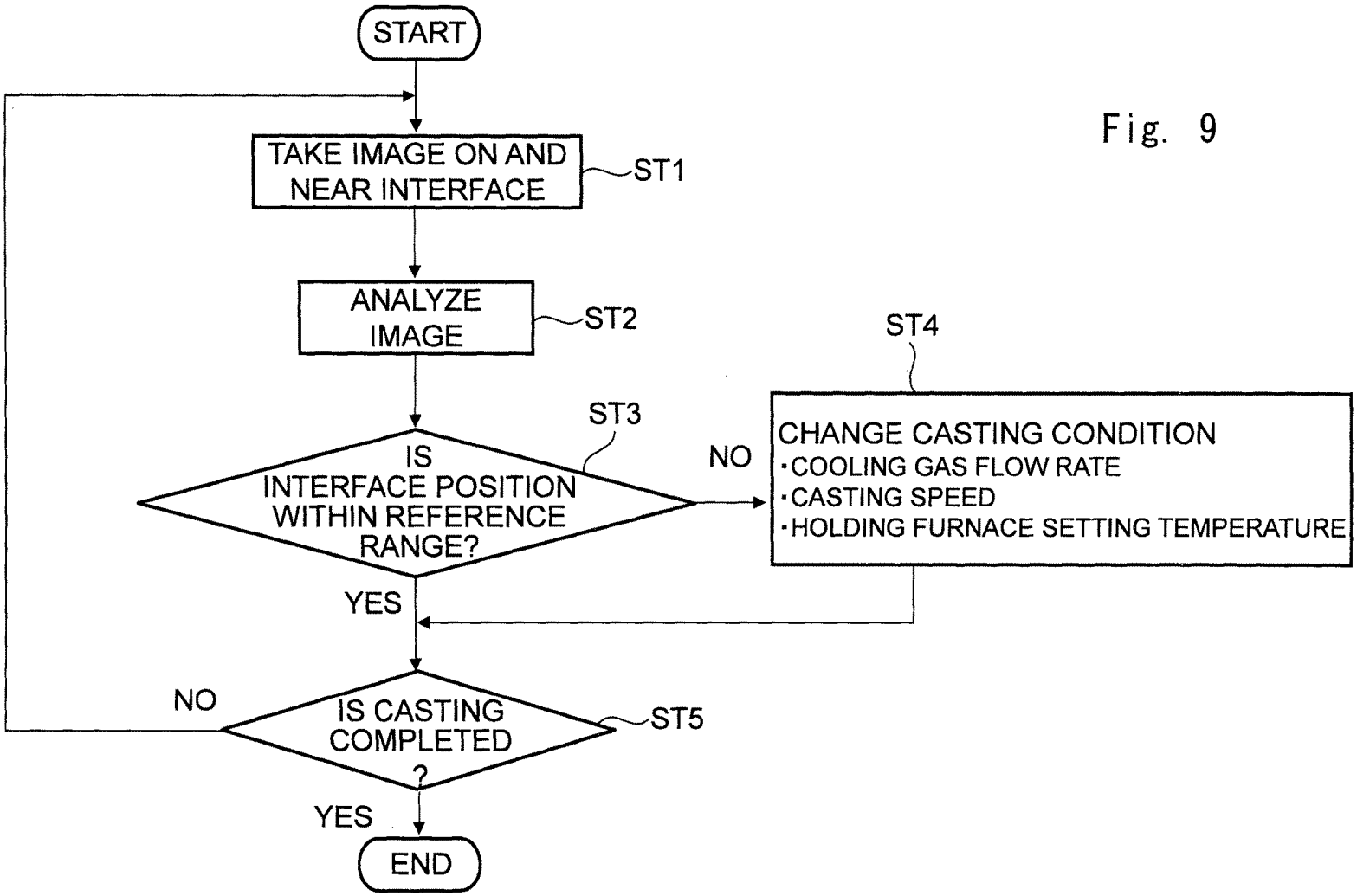
FIG. 9 is a flowchart for explaining a solidification interface control method according to the first exemplary embodiment.

In the free casting method according to the first exemplary embodiment, the solidification interface is controlled so that the solidification interface is kept within a predetermined reference range. A solidification interface control method is explained hereinafter with reference to FIG. 9. FIG. 9 is a flowchart for explaining a solidification interface control method according to the first exemplary embodiment.

Firstly, an image(s) of an area(s) near the solidification interface is taken by the image pickup unit 109 (step ST1).

Next, the image analysis unit 110 analyzes the image(s) taken by the image pickup unit 109 (step ST2). Specifically, fluctuations on the surface of the held molten metal M2 are detected by comparing a plurality of successively-taken images with one another. Then, the image analysis unit 110 determines the boundary between an area in which fluctuations are detected and an area in which no fluctuation is detected as the solidification interface in the images taken by the image pickup unit 109.

Next, the casting control unit 111 determines whether or not the position of the solidification interface determined by the image analysis unit 110 is within a reference range (step ST3). It should be noted that the casting control unit 111 makes the above-described determination by using a different reference range according to the pulling-up angle θ. When the solidification interface position is not within the reference range (No at step ST3), the casting control unit 111 changes one of the cooling gas flow rate, the casting speed, and the holding furnace setting temperature (step ST4). After that, the casting control unit 111 determines whether the casting is completed or not (step ST5).

Specifically, in the step ST4, when the solidification interface determined by the image analysis unit 110 is higher than the upper limit, the casting control unit 111 reduces the pulling-up speed of the pulling-up machine 108, lowers the setting temperature of the molten-metal holding furnace 101, or increases the flow rate of the cooling gas supplied from the cooling gas supply unit 107. On the other hand, when the solidification interface determined by the image analysis unit 110 is lower than the lower limit, the casting control unit 111 increases the pulling-up speed of the pulling-up machine 108, raises the setting temperature of the molten-metal holding furnace 101, or reduces the flow rate of the cooling gas supplied from the cooling gas supply unit 107.

When the solidification interface position is within the reference range (Yes at step ST3), the solidification interface control proceeds to the step ST5 without changing the casting condition.

When the casting has not been completed yet (No at step ST5), the solidification interface control returns to the step ST1. On the other hand, when the casting has been already completed (Yes at step ST5), the solidification interface control is finished.

In the free casting method according to the first exemplary embodiment, a solidification interface is determined by taking an image(s) of an area near the solidification interface and detecting fluctuations on the surface of the molten metal from the image(s). Then, when the solidification interface is not within a reference range, a casting condition is changed. It should be noted that the determination whether the position of the solidification interface is within the reference range or not is made by using a different reference range according to the pulling-up angle θ. Therefore, even when the molten metal is pulled up in an oblique direction, the free casting apparatus can perform feedback control in order to keep the solidification interface within the predetermined reference range, and thereby improve the size accuracy and the surface quality of the cast-metal article.

Second Exemplary Embodiment

Figure 10:
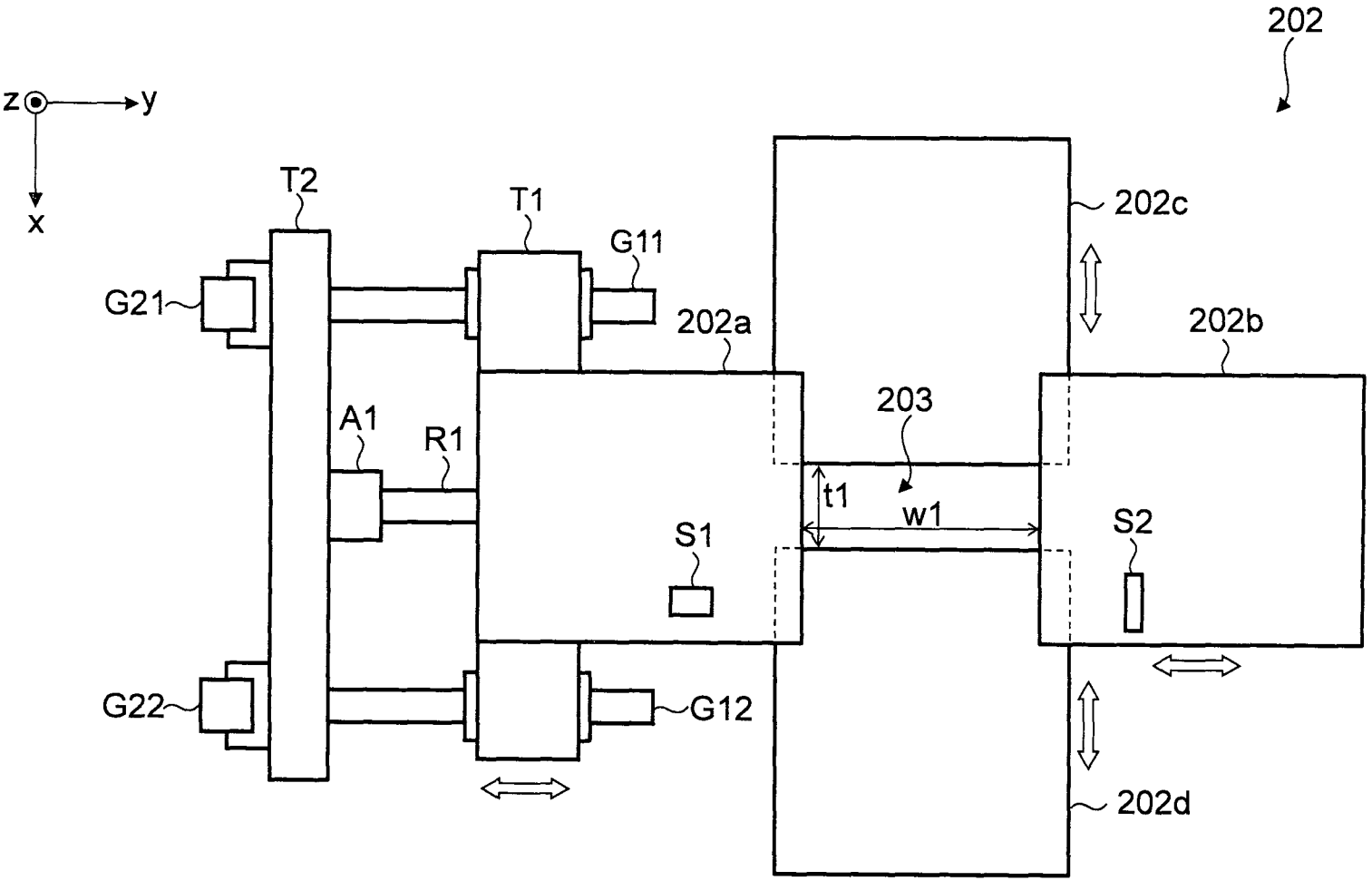
FIG. 10 is a plane view of a shape defining member 202 according to a second exemplary embodiment.
Figure 11:
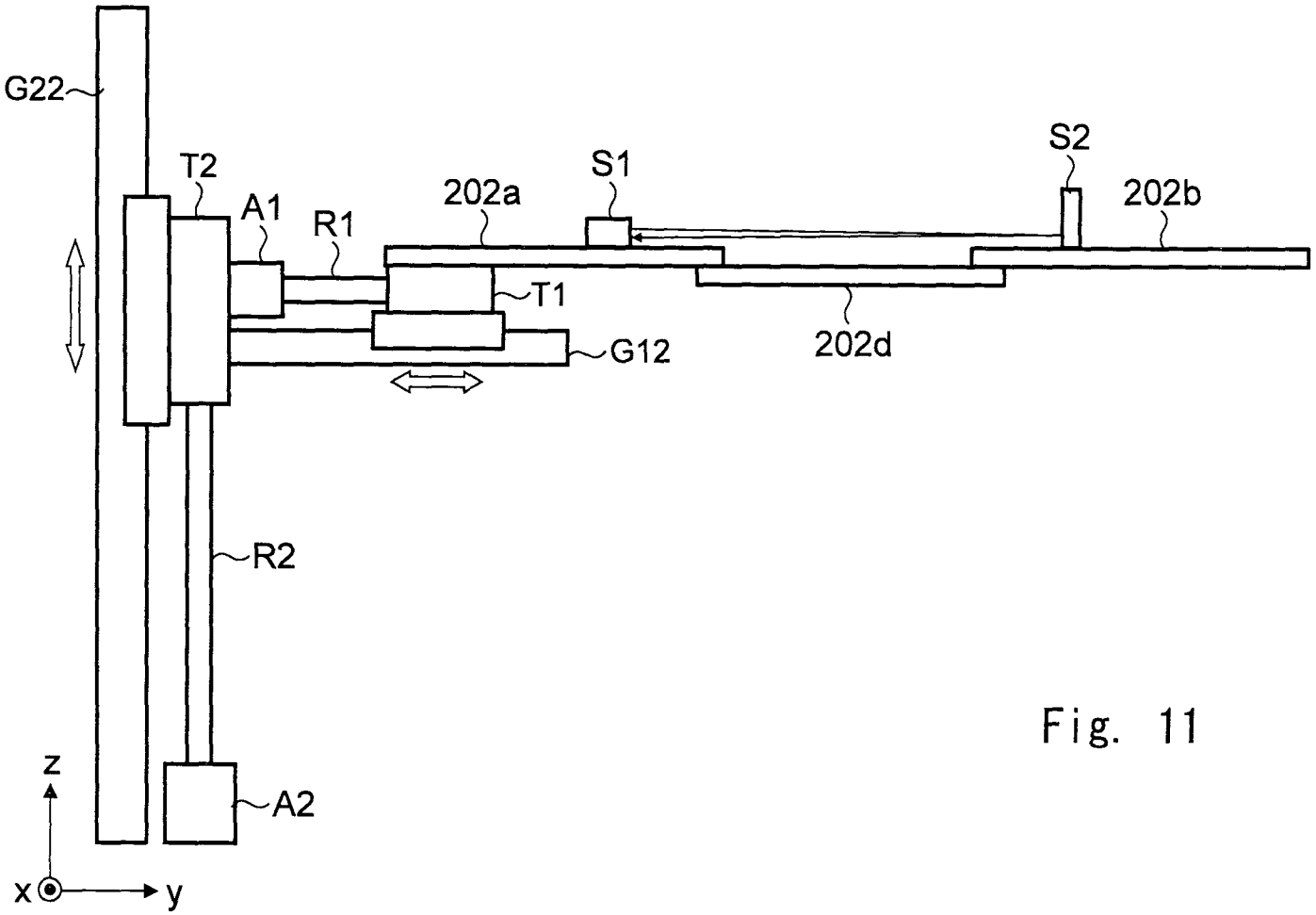
FIG. 11 is a side view of the shape defining member 202 according to the second exemplary embodiment.

Next, a free casting apparatus according to a second exemplary embodiment is explained with reference to FIGS. 10 and 11. FIG. 10 is a plane view of a shape defining member 202 according to the second exemplary embodiment. FIG. 11 is a side view of the shape defining member 202 according to the second exemplary embodiment. Note that the xyz-coordinate systems shown in FIGS. 10 and 11 also correspond to that shown in FIG. 1.

The shape defining member 102 according to the first exemplary embodiment shown in FIG. 2 is composed of one plate. Therefore, the thickness t1 and the width w1 of the molten-metal passage section 103 are fixed. In contrast to this, the shape defining member 202 according to the second exemplary embodiment includes four rectangular shape defining plates 202*a*, 202*b*, 202*c* and 202*d* as shown in FIG. 10. That is, the shape defining member 202 according to the second exemplary embodiment is divided into a plurality of sections. With this configuration, it is possible to change the thickness t1 and the width w1 of the molten-metal passage section 203. Further, the four rectangular shape defining plates 202*a*, 202*b*, 202*c* and 202*d* can be moved in unison in the z-axis direction.

As shown in FIG. 10, the shape defining plates 202*a* and 202*b* are arranged to be opposed to each other in the y-axis direction. Further, as shown in FIG. 11, the shape defining plates 202*a* and 202*b* are disposed at the same height in the z-axis direction. The gap between the shape defining plates 202*a* and 202*b* defines the width w1 of the molten-metal passage section 203. Further, since each of the shape defining plates 202*a* and 202*b* can be independently moved in the y-axis direction, the width w1 can be changed. Note that, as shown in FIGS. 10 and 11, a laser displacement gauge S1 and a laser reflector plate S2 may be provided on the shape defining plates 202*a* and 202*b*, respectively, in order to measure the width w1 of the molten-metal passage section 203.

Further, as shown in FIG. 10, the shape defining plates 202*c* and 202*d* are arranged to be opposed to each other in the x-axis direction. Further, the shape defining plates 202*c* and 202*d* are disposed at the same height in the z-axis direction. The gap between the shape defining plates 202*c* and 202*d* defines the thickness t1 of the molten-metal passage section 203. Further, since each of the shape defining plates 202*c* and 202*d* can be independently moved in the x-axis direction, the thickness t1 can be changed.

The shape defining plates 202*a* and 202*b* are disposed in such a manner that they are in contact with the top sides of the shape defining plates 202*c* and 202*d*.

Next, a driving mechanism for the shape defining plate 202*a* is explained with reference to FIGS. 10 and 11. As shown in FIGS. 10 and 11, the driving mechanism for the shape defining plate 202*a* includes slide tables T1 and T2, linear guides G11, G12, G21 and G22, actuators A1 and A2, and rods R1 and R2. Note that although each of the shape defining plates 202*b*, 202*c* and 202*d* also includes its driving mechanism as in the case of the shape defining plate 202*a*, the illustration of them is omitted in FIGS. 10 and 11.

As shown in FIGS. 10 and 11, the shape defining plate 202*a* is placed and fixed on the slide table T1, which can be slid in the y-axis direction. The slide table T1 is slidably placed on a pair of linear guides G11 and G12 extending in parallel with the y-axis direction. Further, the slide table T1 is connected to the rod R1 extending from the actuator A1 in the y-axis direction. With the above-described configuration, the shape defining plate 202*a* can be slid in the y-axis direction.

Further, as shown in FIGS. 10 and 11, the linear guides G11 and G12 and the actuator A1 are placed and fixed on the slide table T2, which can be slid in the z-axis direction. The slide table T2 is slidably placed on a pair of linear guides G21 and G22 extending in parallel with the z-axis direction. Further, the slide table T2 is connected to the rod R2 extending from the actuator A2 in the z-axis direction. The linear guides G21 and G22 and the actuator A2 are fixed on a horizontal floor surface or a horizontal pedestal (not shown). With the above-described configuration, the shape defining plate 202*a* can be slid in the z-axis direction. Note that examples of the actuators A1 and A2 include a hydraulic cylinder, an air cylinder, and a motor.

Figure 12:
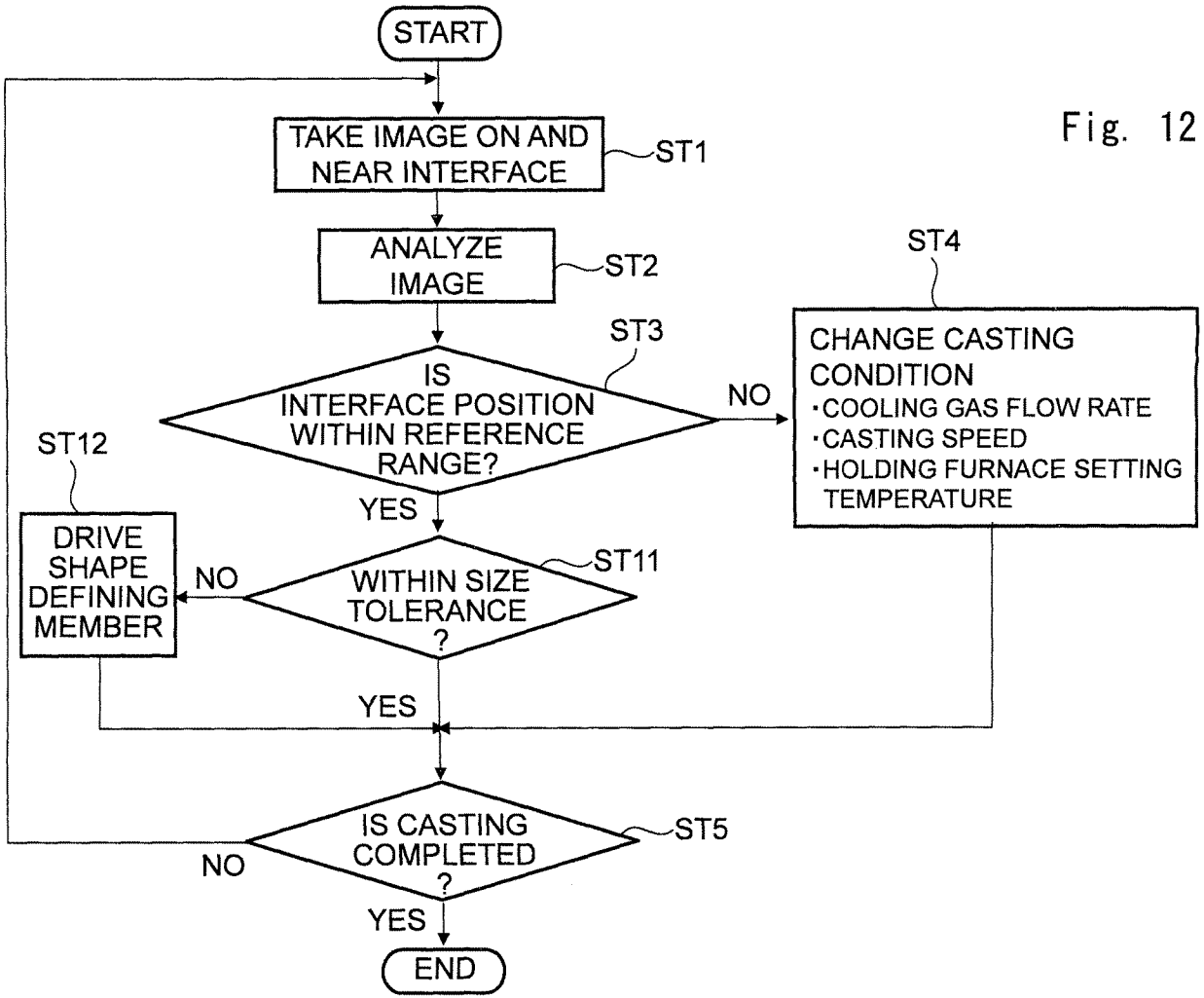
FIG. 12 is a flowchart for explaining a solidification interface control method according to the second exemplary embodiment.

Next, a solidification interface control method according to the second exemplary embodiment is explained hereinafter with reference to FIG. 12. FIG. 12 is a flowchart for explaining a solidification interface control method according to the second exemplary embodiment. Steps ST1 to ST4 in FIG. 12 are similar to those according to the first exemplary embodiment shown in FIG. 9, and therefore their detailed explanations are omitted.

When the solidification interface position is within the reference range (Yes at step ST3), the casting control unit 111 determines whether or not the dimensions (thickness t and width w) of the cast metal M3 on the solidification interface determined by the image analysis unit 110 are within the dimensional tolerances for the cast metal M3 (step ST11). Note that the dimensions (thickness t and width w) on the solidification interface are obtained at the same time that the image analysis unit 110 determines the solidification interface. When the dimensions obtained from the image are not within the dimensional tolerances (No at step ST11), the thickness t1 and/or the width w1 of the molten-metal passage section 203 are/is changed (step ST12). After that, the casting control unit 111 determines whether the casting is completed or not (step ST5).

When the dimensions are within the dimensional tolerances (Yes at step ST11), the solidification interface control proceeds to the step ST5 without changing the thickness t1 and the width w1 of the molten-metal passage section 203.

When the casting has not been completed yet (No at step ST5), the solidification interface control returns to the step ST1. On the other hand, when the casting has already been completed (Yes at step ST5), the solidification interface control is finished.

The rest of the configuration is similar to that of the first exemplary embodiment, and therefore its explanation is omitted.

Similarly to the first exemplary embodiment, the solidification interface is determined by taking an image of an area near the solidification interface and detecting fluctuations on the surface of the molten metal from the image in the free casting method according to the second exemplary embodiment. Then, when the solidification interface is not within the reference range, the casting condition is changed. It should be noted that the determination whether the position of the solidification interface is within the reference range or not is made by using a reference range which differs according to the pulling-up angle θ. Therefore, even when the molten metal is pulled up in an oblique direction, the free casting apparatus can perform feedback control in order to keep the solidification interface within the predetermined reference range, and thereby improve the dimensional accuracy and the surface quality of the cast-metal article.

Further, in the free casting method according to the second exemplary embodiment, the thickness t1 and the width w1 of the molten-metal passage section 203 of the shape defining member 202 can be changed. Therefore, when the solidification interface is determined from the image, the thickness t and the width w on that solidification interface are measured. Then, when these measurement values are not within the dimensional tolerances, the thickness t1 and/or the width w1 of the molten-metal passage section 203 are/is changed. That is, it is possible to perform feedback control in order to keep the dimensions of the cast-metal article within the dimensional tolerances. As a result, the dimensional accuracy of the cast-metal article can be improved even further.

Note that the present invention is not limited to the above-described exemplary embodiments, and various modifications can be made without departing from the spirit and scope of the present invention.

This application is based upon and claims the benefit of priority from Japanese patent application No. 2013-244006, filed on Nov. 26, 2013, the disclosure of which is incorporated herein in its entirety by reference.

REFERENCE SIGNS LIST

11*a* COMPARISON UNIT
11*b* STORAGE UNIT
101 MOLTEN METAL HOLDING FURNACE
102, 202 SHAPE DEFINING MEMBER
103, 203 MOLTEN-METAL PASSAGE SECTION
104 SUPPORT ROD
105 ACTUATOR
106 COOLING GAS NOZZLE
107 COOLING GAS SUPPLY UNIT
108 PULLING-UP MACHINE
109 IMAGE PICKUP UNIT
110 IMAGE ANALYSIS UNIT
111 CASTING CONTROL UNIT
202*a*-202*d* SHAPE DEFINING PLATE
A1, A2 ACTUATOR
G11, G12, G21, G22 LINEAR GUIDE
M1 MOLTEN METAL
M2 HELD MOLTEN METAL
M3 CAST METAL
R1, R2 ROD
S1 LASER DISPLACEMENT GAUGE
S2 LASER REFLECTOR PLATE
SIF SOLIDIFICATION INTERFACE
ST STARTER
T1, T2 SLIDE TABLE

The invention claimed is:

1. A pulling-up continuous casting apparatus comprising:
a holding furnace that holds molten metal;
a shape defining member disposed above a molten-metal surface of the molten metal held in the holding furnace, the shape defining member being configured to define a cross-sectional shape of a cast-metal article to be cast as the molten metal passes through the shape defining member;
an image pickup unit that takes an image of the molten metal that has passed through the shape defining member;
an image analysis unit that detects a waving motion on the molten metal from the image and determines a solidification interface based on presence/absence of the waving motion; and
a casting control unit that changes a casting condition only when the solidification interface determined by the image analysis unit is not within a predetermined reference range, wherein
the casting control unit uses a reference range which differs according to a pulling-up angle of the molten metal and determines whether or not the solidification interface is within that reference range.

2. The pulling-up continuous casting apparatus according to claim 1, wherein the casting control unit includes a storage unit that stores a plurality of predetermined reference ranges, each of the plurality of predetermined reference ranges being determined for a respective pulling-up angle.

3. The pulling-up continuous casting apparatus according to claim 1, wherein the casting control unit calculates the reference range corresponding to the pulling-up angle based on the predetermined reference range for a case where the molten metal is pulled up in a vertical direction and the pulling-up angle.

4. The pulling-up continuous casting apparatus according to claim 1, wherein the casting condition is one of:
a flow rate of a cooling gas for cooling the molten metal that has passed through the shape defining member;
a pulling-up speed of the cast-metal article; and
a setting temperature of the holding furnace.

5. The pulling-up continuous casting apparatus according to claim 1, wherein
the shape defining member is divided into a plurality of sections and able to change the cross-sectional shape,
the image analysis unit detects a dimension of the cast-metal article from the image, and
the casting control unit changes the cross-sectional shape defined by the shape defining member when the dimension is not within a dimensional tolerance.

6. A pulling-up continuous casting method comprising:
pulling up a molten metal held in a holding furnace while making the molten metal pass through a shape defining member, the shape defining member being configured to define a cross-sectional shape of a cast-metal article to be cast;
taking an image of the molten metal that has passed through the shape defining member;
detecting a waving motion on the molten metal from the image and determining a solidification interface based on presence/absence of the waving motion; and
changing a casting condition only when the determined solidification interface is not within a predetermined reference range, wherein
in the changing the casting condition, a reference range which differs according to a pulling-up angle of the molten metal is used and it is determined whether or not the solidification interface is within that reference range.

7. The pulling-up continuous casting method according to claim 6, wherein a reference range is determined in advance for a respective pulling-up angle.

8. The pulling-up continuous casting method according to claim 6, wherein
the reference range in a case where the molten metal is pulled up in a vertical direction is determined in advance, and
the reference range corresponding to the pulling-up angle is calculated based on the reference range in the case where the molten metal is pulled up in the vertical direction and the pulling-up angle.

9. The pulling-up continuous casting method according to claim 6, wherein the casting condition is one of:
a flow rate of a cooling gas for cooling the molten metal that has passed through the shape defining member;
a pulling-up speed of the cast-metal article; and
a setting temperature of the holding furnace.

10. The pulling-up continuous casting method according to claim 6, wherein
the shape defining member is divided into a plurality of sections and thereby able to change the cross-sectional shape,
a dimension of the cast-metal article is detected from the image, and
the cross-sectional shape defined by the shape defining member is changed when the dimension is not within a size tolerance.

* * * * *